US007041038B2

(12) United States Patent
Smith et al.

(10) Patent No.: US 7,041,038 B2
(45) Date of Patent: May 9, 2006

(54) FOLDING MECHANISM FOR A TREADMILL

(76) Inventors: Jeffrey A. Smith, 5219 NW. 33rd Ave., Ft. Lauderdale, FL (US) 33309-6302; Leao Wang, No. 1, La. 233, Sec. 2, Charng Long Road, Taiping (TW) 411

( * ) Notice: Subject to any disclaimer, the term of this patent is extended or adjusted under 35 U.S.C. 154(b) by 9 days.

(21) Appl. No.: 10/843,469

(22) Filed: May 12, 2004

(65) Prior Publication Data

US 2005/0255969 A1 Nov. 17, 2005

(51) Int. Cl.
*A63B 22/02* (2006.01)

(52) U.S. Cl. ..... 482/54

(58) Field of Classification Search ..... 482/54
See application file for complete search history.

(56) References Cited

U.S. PATENT DOCUMENTS 3,643,943 A * 2/1972 Erwin et al. ..... 482/8
4,928,956 A * 5/1990 Chen ..... 482/54
6,254,515 B1 * 7/2001 Carman et al. ..... 482/54
6,811,518 B1 * 11/2004 Lin ..... 482/54

* cited by examiner

*Primary Examiner*—Stephen R. Crow

(57) ABSTRACT

A folding mechanism for a treadmill having a main frame, a platform and a shaft mounted on the main frame. The main frame is adapted for mounting a motor to impart rotary motion to a worm. Meanwhile, the main frame is rigidly connected to a base frame having an sliding groove or rail with an open side. The platform includes front and rear rollers on the under surface thereof. The front rollers are slidably fitted in the sliding rail. The shaft is mounted on the main frame while a yoke with a crossbar and two supporting arms is rotatably mounted on the shaft. The crossbar includes a worm wheel engaging with the worm, and the free end of the supporting arms is pivotally connected to both sides of the platform. Based on the above-mentioned, the treadmill's platform can be lifted in an inclined position. Furthermore, a locking element is employable to fold the platform in a storage position.

2 Claims, 5 Drawing Sheets

FOLDING MECHANISM FOR A TREADMILL

BACKGROUND OF THE INVENTION

1. Fields of the Invention

The invention relates to a folding mechanism for a treadmill, and more particularly, to a folding mechanism utilizing a worm gear to bring a treadmill's platform in a flat and in an inclined position for use. Furthermore, a locking element is employed to bring the treadmill's platform in a folded position for storage.

2. Description of the Related Art

Treadmill is an exercise device consisting of an endless belt on which a person can walk or jog in place. During the exercise session, the feet of the operator will receive reactive force created by a walking platform of the treadmill when they tread thereon.

A conventional treadmill in accordance with TW 91209853, 90207184, 89210559, 88206271, 88206270, 88206203, 88204238, etc., includes a main frame on which an electric control console is mounted. Two supporting arms are pivotably connected to both sides of a front end of a treadmill's platform. Meanwhile, the other end of both supporting arms is screwed on a pull rod for gearing with a worm.

In the aforementioned treadmill, a motor is employed to drive the worm in rotary motion. Meanwhile, the pull rod engaging with the worm undergoes a reciprocating motion to bring the treadmill's platform in an inclined position for use or to bring the platform in a folded position for storage. In use, the above-mentioned operation can be done in reverse, steps to unfold the treadmill's platform back to the operational position. Accordingly, the conventional treadmill applied the rotary motion to be converted into the telescopic motion for displacement.

SUMMARY OF THE INVENTION

It is a primary object of the invention is to provide a folding mechanism for a treadmill, and more particularly, to a folding mechanism utilizing a worm gear to bring a treadmill's platform in a flat and in an inclined position for use. Furthermore, a locking element is employed to bring the treadmill's platform in a folded position for storage.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
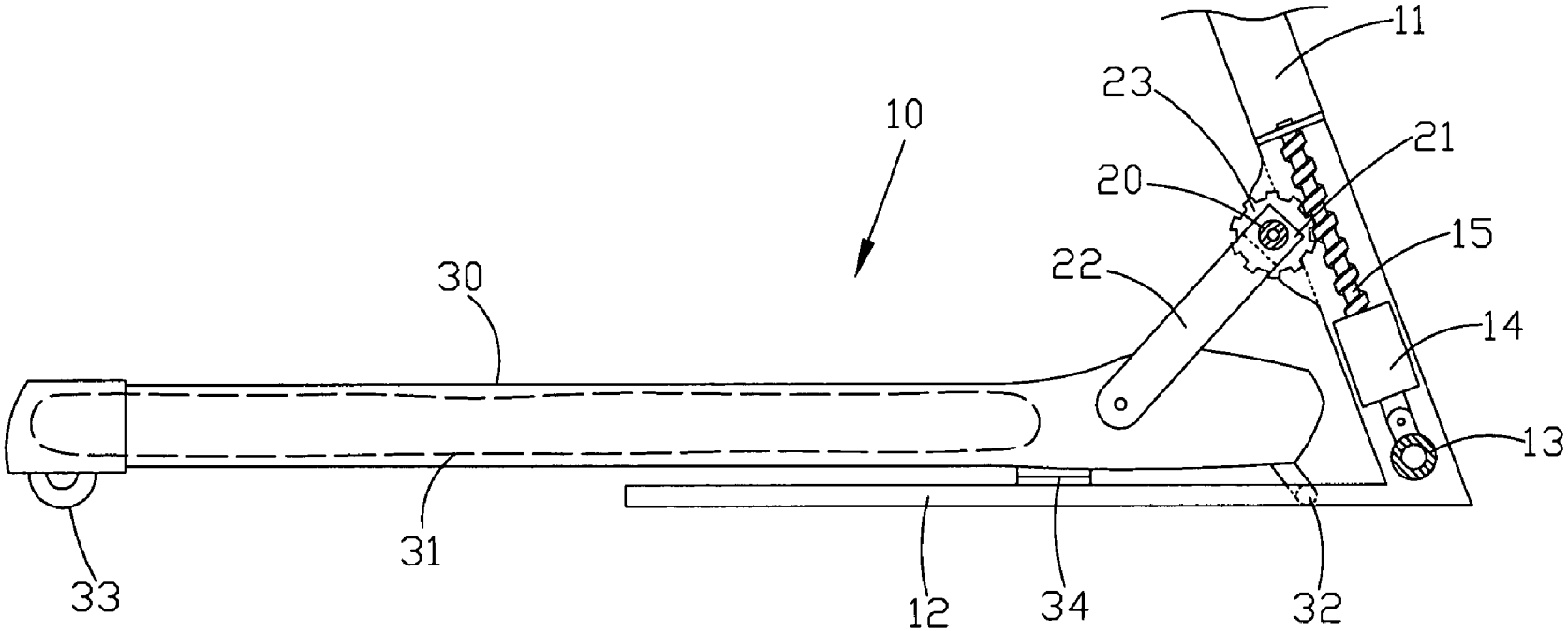
FIG. 1 is a side view of a first embodiment of the folding mechanism of the invention with a treadmill's platform in a flat position for use.
Figure 5:
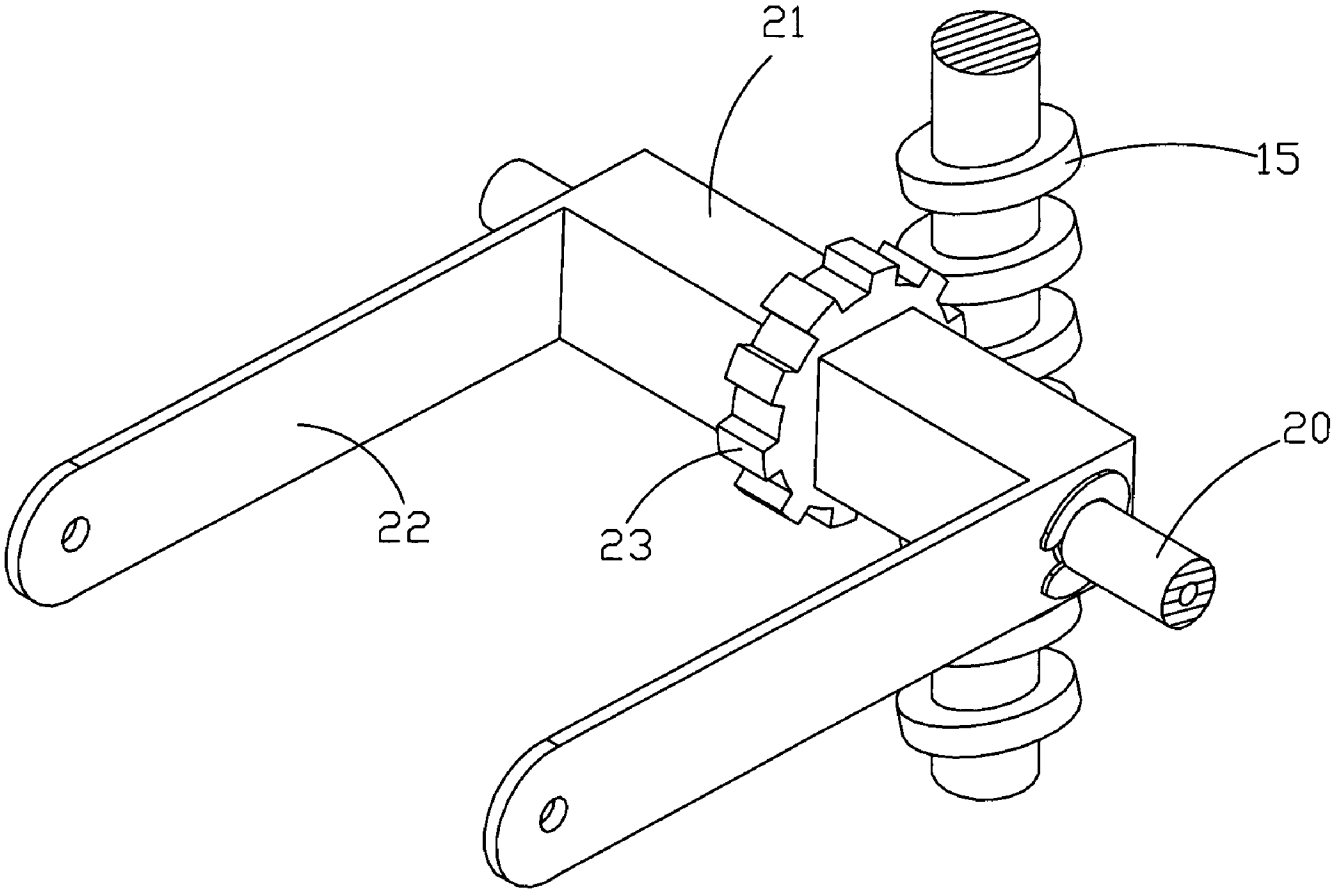
FIG. 5 is a perspective view of a worm gear employed in the folding mechanism of the invention.

Referring to FIGS. 1 and 5, a handle and an electric control console (not shown) can be mounted on the top of a main frame 11 of a treadmill. The main frame 11 has a base frame 12 at the bottom thereof. The main frame 11 is connected with a positioning rod 13 adjacent to the base frame 12. A motor 14 is disposed on the positioning rod 13 for driving a worm 15 in rotation.

In addition, the main frame 11 is provided with a shaft 20 on which a yoke 20 is disposed. The yoke consists of a crossbar 21 and two supporting arms 22 perpendicular to the crossbar 21. The crossbar 21 includes a worm wheel 23 engaging with and driven by the worm 15 for bringing the two supporting arms 22 in rotation about the shaft 20.

The two supporting arms 22 are pivotally supported on both sides of a front end of a treadmill's platform 30 with its continuous moving belt 31. Front and rear rollers 32, 33 are mounted on the under surface of the platform 30. A cushioning pad 34 is interposed between the front and rear rollers 32, 33 for damping the treading impacts to the platform 30 and protecting the feet of an operator from injuries.

As shown in FIG. 1, the treadmill 10 consisting of the aforementioned components is operable in horizontal position. The rear rollers 33 is rollable on the ground while the front rollers 32 are slidable in an open sliding groove or rail (not shown) of the base frame 12.

Figure 2:
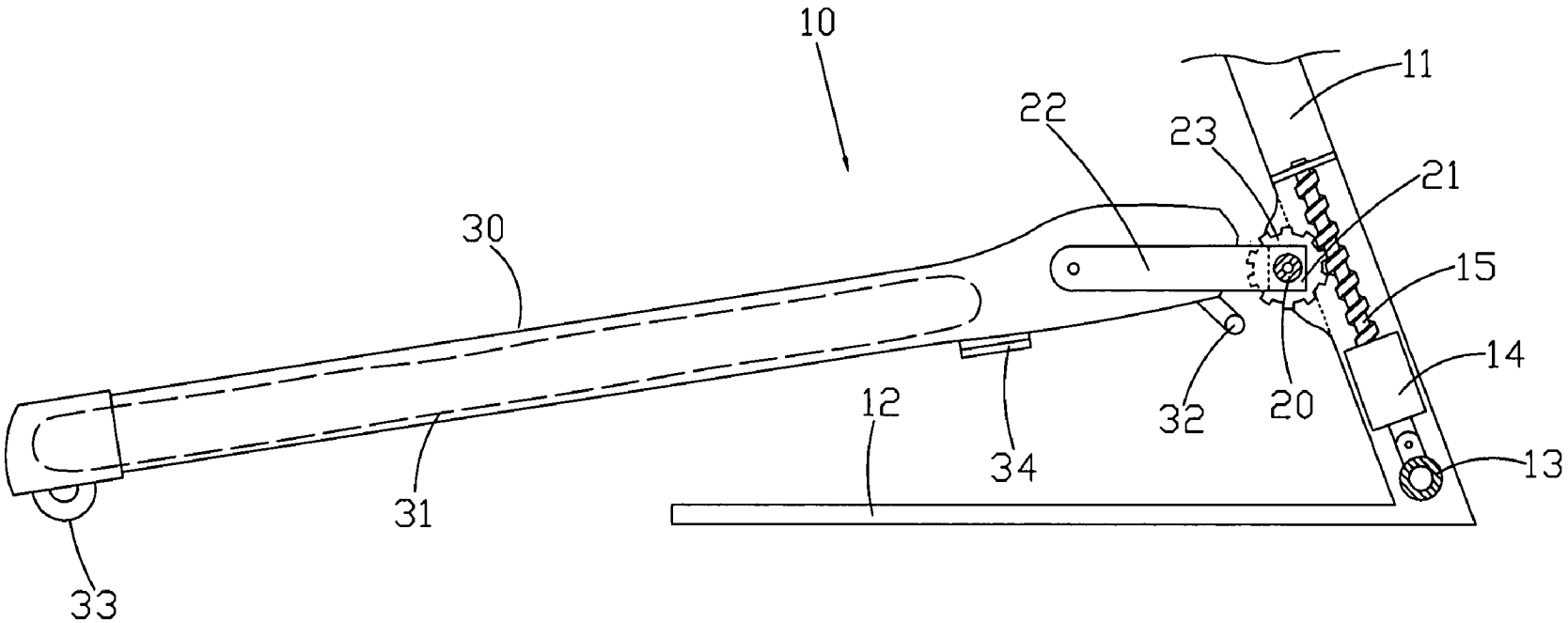
FIG. 2 is a side view of FIG. 1 with the treadmill's platform raised in an inclined position for use.

In adjusting the angle of the platform 30 with respect to the base frame 12, the operator can give a command signal through the electric control console to activate the motor 14 for driving the worm 15 in rotation. Due to the engagement of the worm 15 with the worm wheel 23, the crossbar 21 together with the two supporting arms 22 are rotatable with the worm wheel 23. As a result, the front end of the platform 30 are gradually lifted by both supporting arms 22 until a desired sloping surface is reached, as shown in FIG. 2. So, the platform 30 is adapted to simulate the sloping of an uphill road.

It is to note that the axes of the worm 15 and the worm wheel 23 are at right angles. As a result, the longitudinally rotary motion of the worm 15 can be converted into the laterally rotary rotation of the crossbar 21 to bring the platform 30 in different positions for use.

Figure 3:
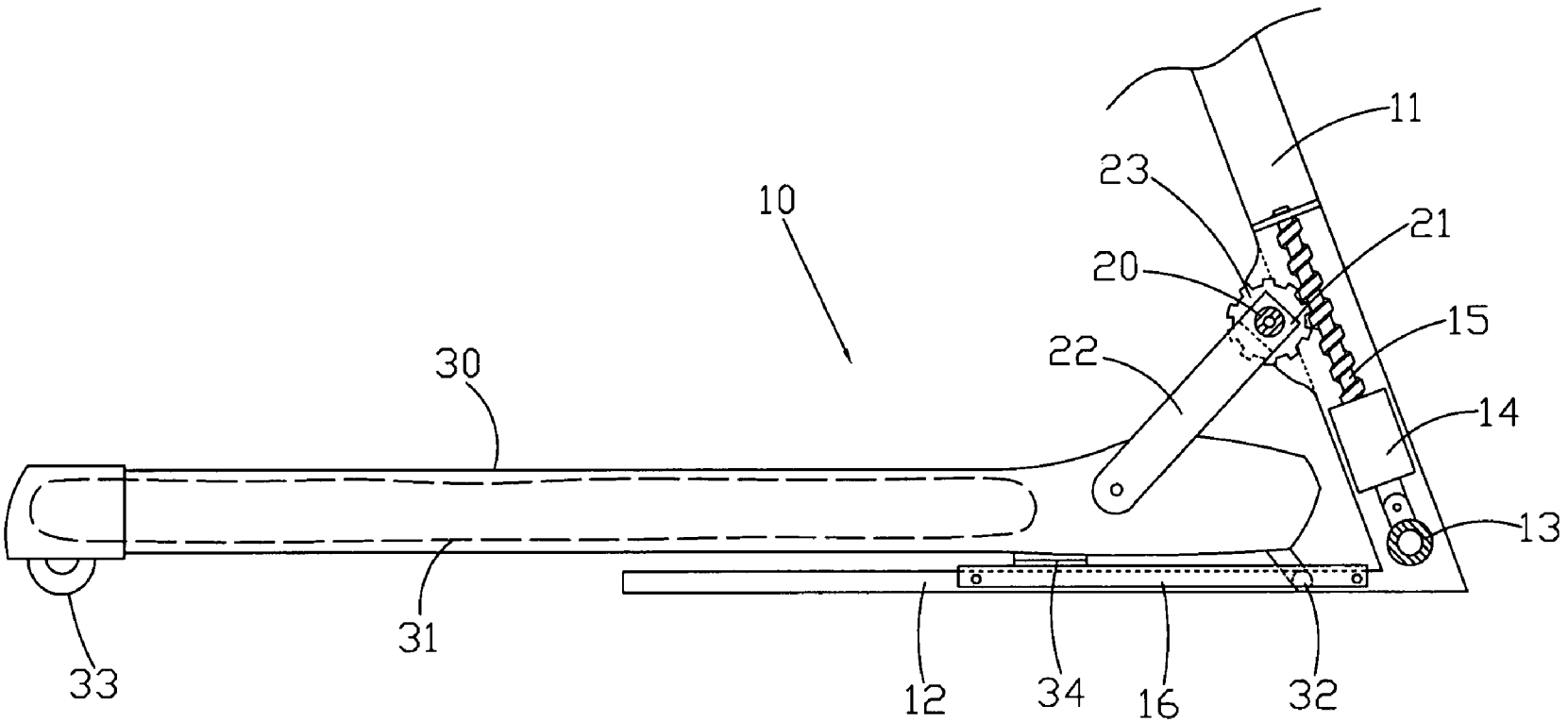
FIG. 3 is a side view of a second embodiment of the folding mechanism of the invention with a treadmill's platform in a flat position for use.

Make sure if the platform 30 is brought back to its original position prior to the performance of the folding action. If the platform 30 is situated in a sloping position, a control signal has to be given through the electric control console to activate the motor 14 for bringing the platform 30 back to its original flat position, as shown in FIG. 3. Moreover, a locking element 16 resides in the sliding groove or rail of the base frame 12 so that the sliding groove or rail is convertible from the open state into a semi-open state. By confirming the locking element 16 in the sliding groove or rail of the base frame 12, the front rollers 32 is slidable only in the sliding groove or rail without removal therefrom.

Figure 4:
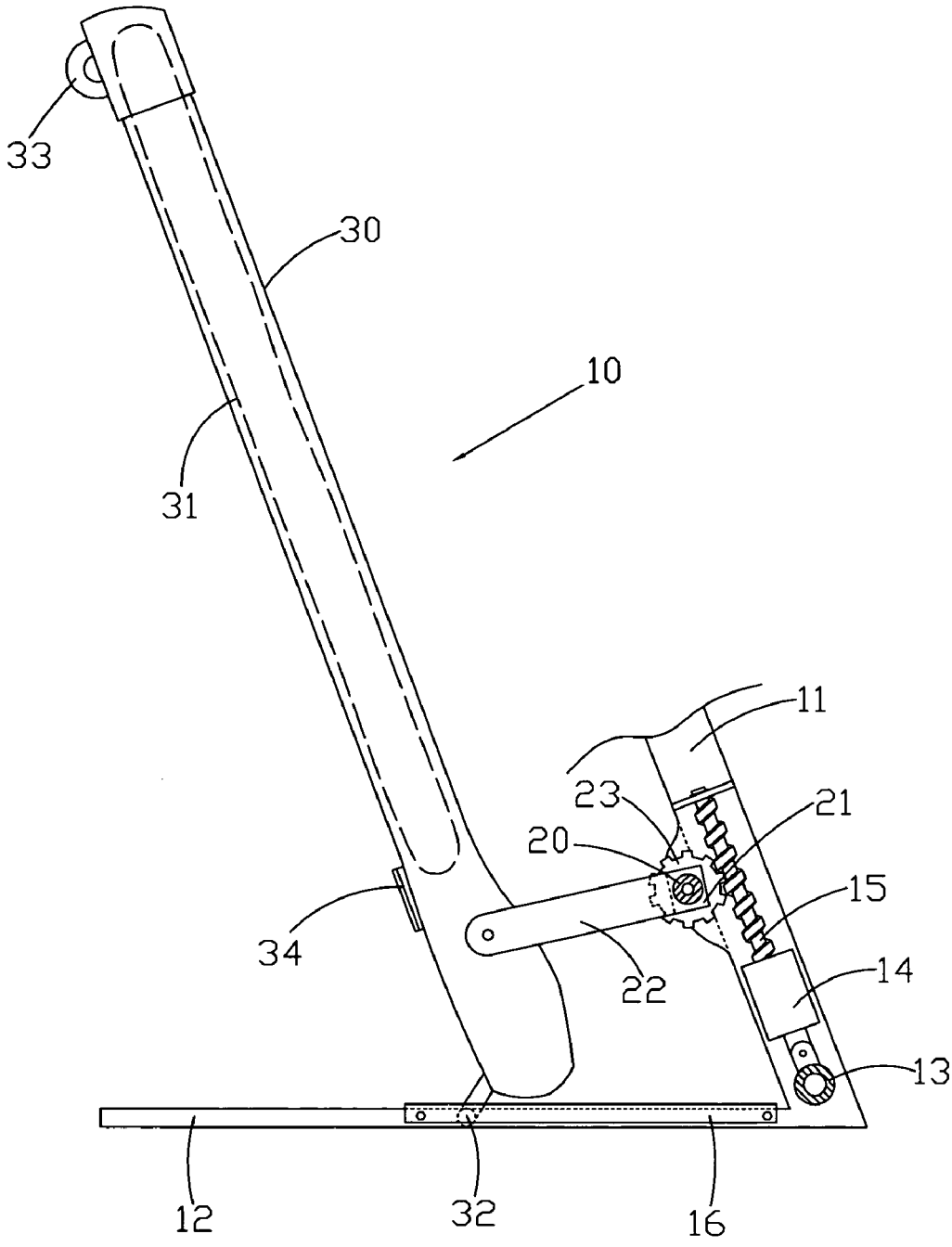
FIG. 4 is a side view of FIG. 3 with the treadmill's platform folded in a storage position.

In renewal of the above-mentioned operation to activate the motor 14 for driving the worm 15, the worm wheel 23 engaging with the worm 15 is brought into rotation. So, the crossbar 21 and the supporting arms 22 are rotatable about the shaft 20. As the front rollers 32 are confined in the sliding groove or rail, the front end of the platform 30 can't be lifted. Thus, the front rollers 32 serves as a fulcrum to allow the rear rollers 33 to lift the platform 30 free of contact with the ground. Accordingly, the rear end of the platform 30 gradually rises, the front rollers 32 undergo a linear movement along the sliding groove or rail and support the whole weight of the platform 30 until the platform 30 is folded in a storage position (see FIG. 4).

In order to bring the platform 30 back to its original position for use, a renewal of the above-mentioned operation is done to activate the motor 14 for driving the worm 15 in reverse rotation. As a result, the worm wheel 23 coupled with the crossbar 21 and the supporting arms 22 is rotatable about the shaft 20 for lowering the platform 30 in an unfolded position for use.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A folding mechanism for a treadmill comprising:

a) a main frame having a motor imparting a rotary motion to a worm gear, the main frame being rigidly connected to a base frame with an open side;

b) a platform having front and rear rollers on the under surface thereof, a continuous moving belt being rotatable about the platform, the front rollers being slidably connected to the base frame; and c) a shaft mounted on the main frame, a yoke consisting of a crossbar and two supporting arms being rotatably mounted on the shaft, the crossbar having a worm wheel engaging with the worm gear, the free end of the supporting arms being pivotally connected to both sides of the platform, respectively, whereby, when the worm gear is driven by the motor in rotation, the rotary motion of the worm gear is converted by the worm wheel to bring the platform in a flat and in an inclined position for use due to the fact that the two axes of the worm gear and the crossbar are at right angles.

2. The folding mechanism for a treadmill of claim 1 further comprising a locking element for confining the front rollers within the base frame, wherein the platform is folded in a storage position.

* * * * *